US007380294B2

(12) United States Patent
Lev et al.

(10) Patent No.: US 7,380,294 B2
(45) Date of Patent: Jun. 3, 2008

(54) BATH APPARATUS WITH PRESSURIZED FLUID MASSAGE

(75) Inventors: Mordechai Lev, West Bloomfield, MI (US); Stephen Chung, Taipei (TW)

(73) Assignee: FKA Distributing Co., Commerce Township, MI (US)

( * ) Notice: Subject to any disclaimer, the term of this patent is extended or adjusted under 35 U.S.C. 154(b) by 410 days.

(21) Appl. No.: 11/083,725

(22) Filed: Mar. 18, 2005

(65) Prior Publication Data

US 2006/0207017 A1 Sep. 21, 2006

(51) Int. Cl.
*A47K 3/022* (2006.01)

(52) U.S. Cl. ..... 4/622; 601/27

(58) Field of Classification Search ..... 4/622; 601/22, 27, 28, 29, 30, 31, 32
See application file for complete search history.

(56) References Cited

U.S. PATENT DOCUMENTS

| | | | | |
|---|---|---|---|---|
| 60,521 | A | 12/1866 | Isaacs | 4/622 |
| 1,534,618 | A | 4/1925 | Taylor et al. | 4/622 |
| 3,741,201 | A | 6/1973 | Oudkerk | 601/156 |
| 3,837,334 | A | 9/1974 | Johnson | 601/19 |
| 4,485,503 | A | 12/1984 | Rolando et al. | 4/622 |
| 4,497,313 | A | 2/1985 | Kurosawa | 601/16 |
| 4,523,580 | A | 6/1985 | Tureaud | 601/104 |
| 4,620,529 | A | 11/1986 | Kurosawa | 601/157 |
| 4,807,602 | A | 2/1989 | Scarborough et al. | 601/104 |
| 6,289,900 | B1 | 9/2001 | Kay | 601/166 |
| D453,836 | S * | 2/2002 | Gillette et al. | D24/213 |
| 6,363,548 | B1 | 4/2002 | Kuo | 4/622 |
| 6,438,768 | B1 | 8/2002 | Yen | 4/622 |
| 6,602,212 | B1 | 8/2003 | Ahn | 4/541.6 X |
| 6,698,038 | B2 | 3/2004 | Bastia et al. | 4/622 |
| 6,805,678 | B2 | 10/2004 | Cafaro | 4/622 X |
| 6,973,683 | B2 * | 12/2005 | Lev et al. | 4/622 |
| 7,192,406 | B2 * | 3/2007 | Marten | 601/32 X |
| 2003/0220593 | A1 | 11/2003 | Morton | 4/622 X |
| 2003/0226201 | A1 | 12/2003 | Leung et al. | 4/622 |
| 2004/0087883 | A1 | 5/2004 | Berger | 601/167 |
| 2004/0117905 | A1 | 6/2004 | Gruenwald | 4/541.1 |

(Continued)

FOREIGN PATENT DOCUMENTS

| | | |
|---|---|---|
| DE | 37 36 476 C1 | 2/1989 |

(Continued)

OTHER PUBLICATIONS http://www.shoplifestyle.com, Ultra massaging heated foot spa—30 Day Money Back Guarantee, 2 pages.

(Continued)

*Primary Examiner*—Robert M Fetsuga
(74) *Attorney, Agent, or Firm*—Brooks Kushman P.C.

(57) ABSTRACT

The present invention provides a bath apparatus for bathing a body part. The bath apparatus includes a chamber for containing fluid, and a lid mounted to the bath chamber. A showerhead is mounted to an underside of the lid and is oriented towards the bath chamber. A fluid pump draws fluid from the bath chamber and pumps the fluid through the showerhead for providing a pressurized fluid massage effect upon the body part. The showerhead may be viewable from atop the lid for visual identification of a product feature and for a visual fluid flow effect in operation.

17 Claims, 6 Drawing Sheets

U.S. PATENT DOCUMENTS

| | | | | |
|---|---|---|---|---|
| 2004/0177438 | A1 | 9/2004 | Gruenwald et al. | 4/560.1 |
| 2004/0194205 | A1 | 10/2004 | Leung | 4/622 |
| 2004/0199991 | A1 | 10/2004 | Ciechanowski | 4/541.1 |
| 2005/0081292 | A1 | 4/2005 | Lev et al. | 4/622 |

FOREIGN PATENT DOCUMENTS

| | | | |
|---|---|---|---|
| GB | 2 314 015 | A | 12/1997 |
| JP | H06-046963 | A | 2/1944 |
| JP | H06-046964 | A | 2/1994 |
| JP | H06-217896 | A | 8/1994 |
| JP | H06-217898 | A | 8/1994 |
| JP | H06-217899 | A | 8/1994 |
| JP | H06-339509 | A | 12/1994 |
| WO | 2006101820 | A1 | 9/2006 |

OTHER PUBLICATIONS

Patent Cooperation Treaty International Search Report and Written Opinion for related application PCT/US06/09056, mailed Aug. 3, 2006, 7 pages.

International Preliminary Report for corresponding International Application No. PCT/US06/09056, mailed Jul. 13, 2007, 5 pages.

* cited by examiner

BATH APPARATUS WITH PRESSURIZED FLUID MASSAGE

BACKGROUND OF THE INVENTION

1. Field of the Invention

The invention relates to an apparatus for bathing body parts, such as the feet or hands.

2. Background Art

Most people experience foot problems at some time in their lives. This is not surprising, considering that many people are employed in jobs that require them to be on their feet all day. In fact, even an average day of walking can exert force equal to several hundred tons of pressure on the feet.

In an attempt to alleviate a variety of podiatric problems, bathing of the feet has become a recognized therapeutic method. For example, soaking soothes the feet and aids in recovery from fatigue. Bathing of the feet also stimulates the circulation of blood therethrough, which results in increased metabolism and excretion. In addition, foot bathing facilitates the removal of painful growths such as calluses, bunions, and corns.

Many types of footbaths have been utilized as therapeutic devices for the feet. Typically, footbaths provide heated water for which the temperature is maintained via electrical means. In addition, current footbaths often provide massage to the feet through vibration of the footbath. Vibratory massage enhances the therapeutic results achieved with soaking alone by further increasing circulation, as well as relaxing and massaging the muscles.

In addition to vibratory massage, a footbath may employ the use of water jets to provide concentrated massage to different areas of the feet. Often the jets recirculate water within a bath chamber of the footbath, and thus, the jets are oriented within the bath chamber for proximity to the water source. The jets that are oriented within the bath chamber are often directed transversely from sidewalls of the bath chamber, or upwards from a platform of the bath chamber.

Alternatively, the prior art has offered immobile foot washing apparatuses that direct water in a downward direction. The immobile foot washing apparatuses are often complex and do not share the benefits of compactness, mobility and price, as do the conventional footbaths with water jets. Further, due to these drawbacks, immobile foot washing apparatuses are generally not targeted to the consumer market.

When marketing footbaths to the consumer market, it is important to display features of the product, particularly at the point of sale. Packaging and advertising are often beneficial for conveying information about a product's features. However, it is common that retailers may market footbaths by displaying the actual products outside of the packaging. Thus, it is beneficial if a consumer may identify features of a product by viewing the product. For example, the pressurized water massage effect of water jet footbaths may be apparent due to the orientation of the water jets in the side walls or the platform of the bath chamber.

Therefore, a need exists for a bath apparatus having a fluid output for providing a fluid massage effect, wherein the location of the fluid output is not limited by proximity to the bath chamber, yet the bath apparatus may be compact and mobile. Additionally a need exists for a bath apparatus having a fluid output that provides a desired fluid massage effect wherein this feature is viewable externally without limiting the location of the output.

SUMMARY OF THE INVENTION

An aspect of the present invention is to provide a bath apparatus having a bath chamber for containing fluid. A lid is mounted to the bath chamber and extends partially over the bath chamber. A showerhead is provided on an underside of the lid and is oriented towards the bath chamber. A fluid pump draws fluid from the bath chamber and pumps the fluid through the showerhead for providing a pressurized fluid massage effect upon the body part received within the bath chamber.

A further aspect of the present invention is wherein the showerhead is integrated with the lid.

Yet another aspect of the present invention is wherein the showerhead is viewable from atop the lid.

Another aspect of the present invention is to provide a fluid channel in the lid for conveying fluid to the showerhead.

Yet another aspect of the present invention is to provide a pair of showerheads.

An even further aspect of the present invention is wherein the lid is at least partially transparent so that a user may view the flow of fluid through the showerhead.

Another aspect of the present invention is to provide false nozzle configurations formed within the showerhead so that the user may visually identify the showerhead when the showerhead is not in operation.

An aspect of the present invention is to provide a bath apparatus having a bath chamber for containing fluid. A lid is mounted to the bath chamber and extends partially over the bath chamber. A fluid nozzle is provided on the lid and is oriented towards the bath chamber. A fluid pump draws fluid from the bath chamber and pumps the fluid through the nozzle for providing a pressurized fluid massage effect upon the body part received within the bath chamber. The lid and the nozzle are at least partially transparent so that a user may view the nozzle and flow of fluid therethrough.

DETAILED DESCRIPTION OF EMBODIMENT(S) OF THE INVENTION

Figure 1:
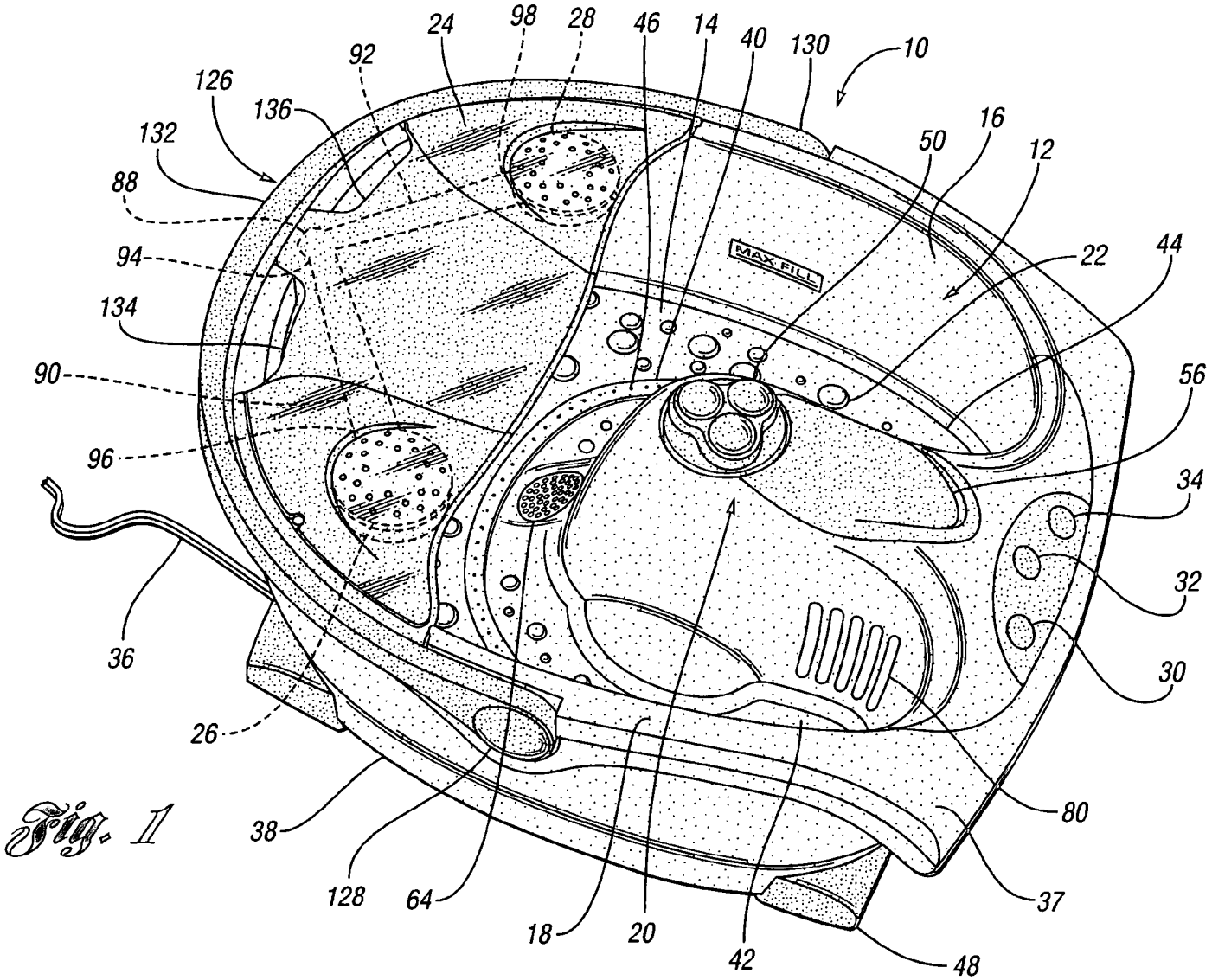
FIG. 1 is a perspective view of a bath apparatus in accordance with the present invention.

FIG. 1 shows a bath apparatus 10 in accordance with the present invention. The bath apparatus 10 can be used to provide heat, water jets, bubbles, and combinations thereof to body parts, such as feet. The bath apparatus 10 is preferably constructed from a plastic material so as to be lightweight and portable, as well as durable, leakproof, and corrosion resistant. Although the bath apparatus 10 is illustrated and described herein as being particularly adaptable for use as a footbath, it is understood that the bath apparatus 10 of the present invention may be used for bathing other body parts, such as the hands.

The bath apparatus 10 includes a bath chamber 12 for containing fluid, such as water, and receiving the body part, such as the foot, therein. The bath chamber 12 includes a bottom surface 14 and a wall structure 16 extending upwardly therefrom. The wall structure 16 terminates in an upper surface 18 that includes a contact portion 20 adapted to be exposed when water is contained in the bath chamber 12. The bottom surface 14 can be generally parallel to a supporting surface on which the bath apparatus 10 is placed, or alternatively, the bottom surface 14 could be slanted downward toward the user.

The bath chamber 12 is of a length and width to accommodate the feet of an adult user, such that sufficient space is provided for the user's feet to be readily inserted and removed, and to allow the feet to be moved about slightly while in position within the bath chamber 12. In a preferred embodiment, the bath chamber 12 is generally U-shaped and the contact portion 20 is generally peninsular and centrally disposed within the bath chamber 12. With this configuration, a user's feet are received on either side of the peninsular contact portion 20, wherein the feet are spaced apart sufficiently to provide comfortable placement. For use, the bath chamber 12 is filled with water to a level such that a user's feet may be submerged up to approximately the height of the ankles. A maximum fill level may be indicated, such as the marking illustrated in FIG. 1, so that an optimal fill level is obtained with the combination of water and feet placed within the bath chamber 12. A user can then easily remove his/her feet for placement on contact portion 20 for targeted therapy as described below. Of course, it is understood that contact portion 20 can have any location on bath apparatus 10 which remains uncovered by water and is accessible to the user.

Figure 2:
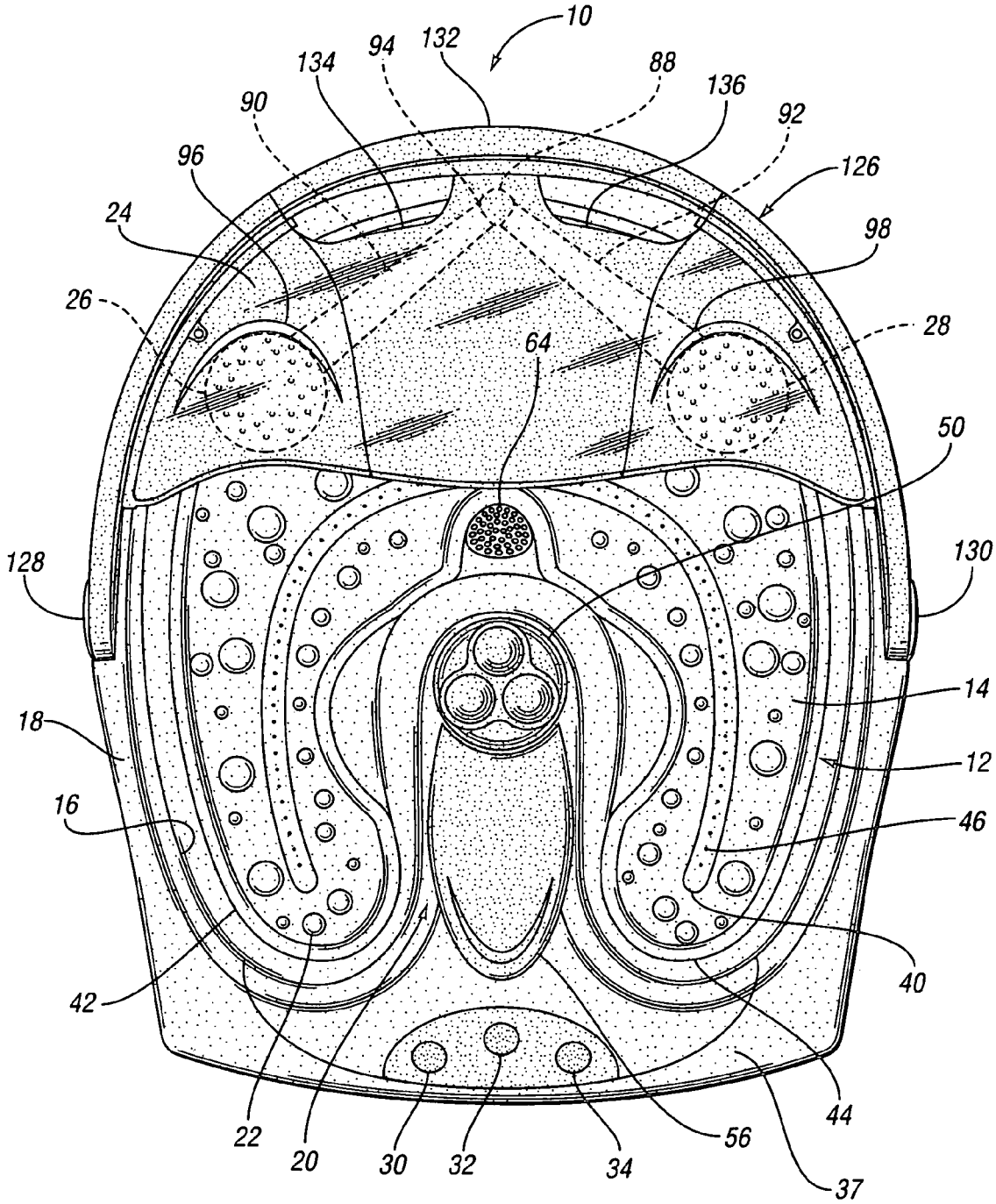
FIG. 2 is a top plan view of the bath apparatus shown in FIG. 1.

With reference to FIGS. 1 and 2, the bottom surface 14 of bath chamber 12 includes a plurality of raised nodes 22 which can be of varying sizes. The nodes 22 function to massage the feet upon contact, and also allow water to flow under them. As shown in FIGS. 1 and 2, bath apparatus 10 further includes a lid 24 adapted to be attached to the wall structure 16 to at least partially cover an opening of the bath chamber 12. The lid 24 is preferably constructed from a plastic material, and is sufficiently rigid so that it can be used as a foot rest when only one foot is submersed with the bath chamber 12. The lid 24 also includes a pair of showerheads 26, 28 for providing a pressurized fluid massage effect to the user's feet when disposed within the bath chamber 12. Each showerhead 26, 28 may be, for example, an array of nozzles for conveying pressurized fluid.

The bath apparatus includes three operational switches, namely massage/heat switch 30, shower switch 32 and bubbles/heat switch 34. Each switch 30, 32, 34 operates a feature independent of one another so that a user may select one or a combination of these features. Wiring interconnects the switches 30, 32, 34 with each of the corresponding mechanical/electrical assemblies described below, which are then powered via connection of a standard power cord 36 to any 110 V AC outlet.

Figure 3:
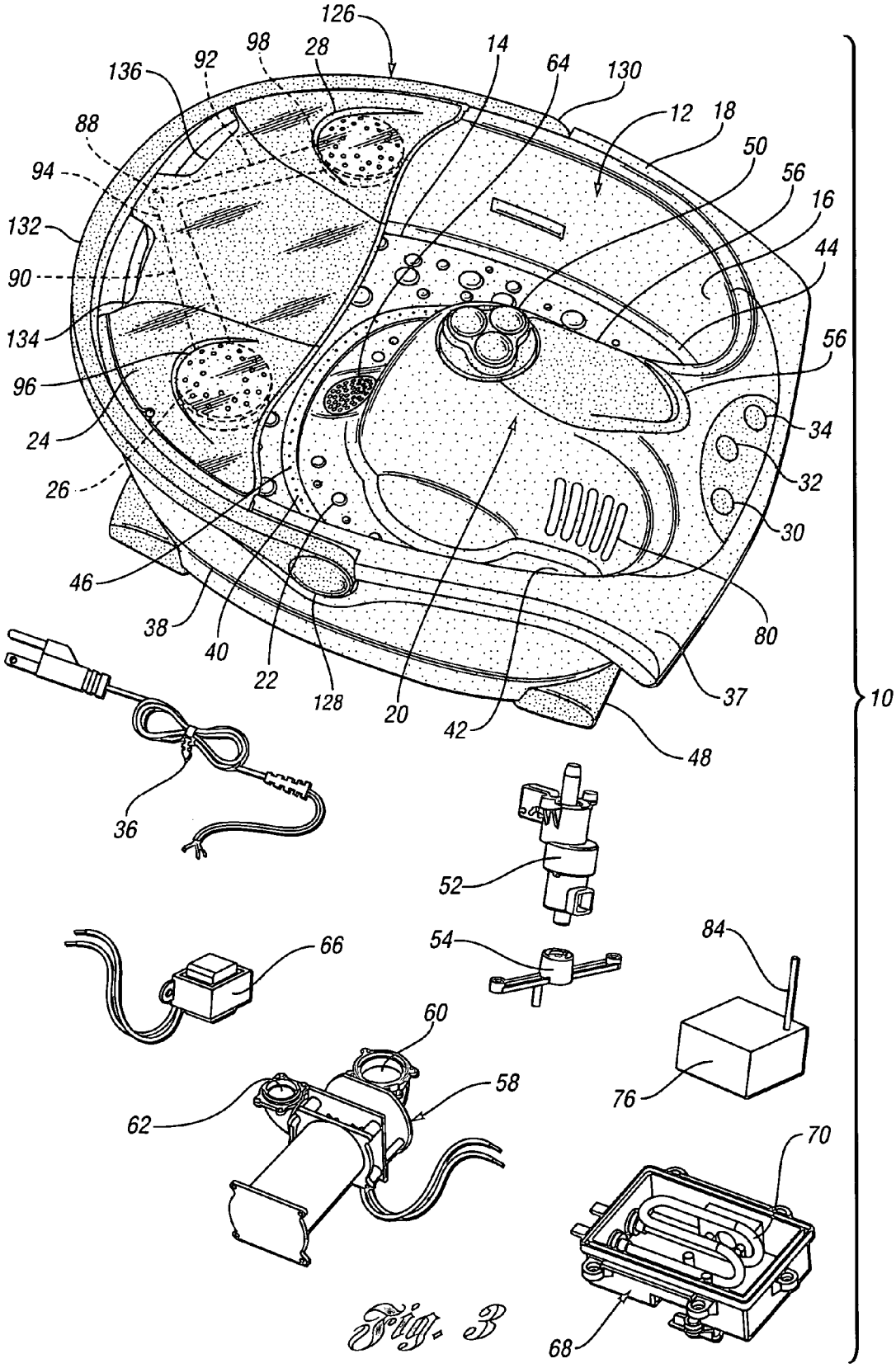
FIG. 3 is a partially exploded view of the bath apparatus shown in FIG. 1.

Referring now to FIGS. 1-3, several mechanical/electrical assemblies of bath apparatus 10 of the present invention will now be described. The bath chamber 12 is provided within an upper housing portion 37. Each of the following assemblies is housed in a cavity provided between the upper housing portion 37 and a lower housing portion 38. A heater (not shown) is provided in communication with the bath chamber 12 and is powered by either of the massage/heat switch 30 and bubbles/heat switch 34. The heater may be a rope heating element that is operable to conduct heat to the water contained within the bath chamber 12. The heated water maintained by the rope heating element relieves tired muscles and promotes circulation of the blood. The rope heating element is positioned to wind back and forth to substantially cover bath chamber bottom surface 14. The rope heating element preferably includes insulated conducting wires, wherein the conductive materials are capable of transmitting heat to the bath chamber bottom surface 14 without generating temperatures that exceed the melting point of the plastic material used to construct the bath apparatus.

Rope heating elements are well known in the art of footbaths and are disclosed in assignee's U.S. Pat. No. 6,568,000 B1 issued to Kaufman et al., titled Bath Apparatus with Therapy Centers; and U.S. Pat. No. 6,725,471 B2 issued to Ferber et al., titled Bath Apparatus. The Kaufman et al. and Ferber et al. patents are incorporated in their entirety by reference herein.

The bath apparatus 10 further includes an air pump (not shown) disposed adjacent to bottom surface 14 of bath chamber 12 and in communication therewith. The pump is turned on and off by the bubbles/heat switch 34. The pump directs air into bath chamber 12 to generate air bubbles in the water contained therein. The pump forces air through an outlet tube which is connected to an injection molded bubble egress strip or tube 40 formed in communication with bath chamber bottom surface 14. The egress tube 40 is generally U-shaped and extends from a first side 42 to a second side 44 of the bath chamber bottom surface 14. Air is forced out of a plurality of egress holes 46 that are provided along the bubble egress tube 40 to form air bubbles in the water contained in bath chamber 12. Of course, the outlet tube and the egress tube 40 could be constructed as a single component. Alternatively, one egress tube could be disposed within the first side 42 of bottom surface 14, and another egress tube could be disposed within the second side 44 of bottom surface 14.

In addition to the generally U-shaped configuration of the bubble egress tube 40 depicted in FIGS. 1 and 2, the bubble egress tube 40 can be constructed to have various configurations which provide more complete coverage of bath chamber bottom surface 14. For example, bubble egress tube 40 can have a linear configuration, a continuous curvilinear configuration, including at least one generally S-shaped segment or at least one reverse curve, such as a serpentine configuration, as illustrated in the Ferber et al. U.S. Pat. No. 6,725,471. Alternatively, the bubble egress tube 40 can include a continuous configuration of linear segments, such as a square-wave or a sawtooth configuration, as illustrated in the Ferber et al. U.S. Pat. No. 6,725,471.

The bubble egress tube 40 is disposed below the bath chamber bottom surface 14, such that the plurality of egress holes 46 are flush with bottom surface 14. Alternatively, the bubble egress tube 40 may protrude at least partially above bottom surface 14, such that egress holes 46 are raised above bottom surface 14. The plurality of bubble egress holes 46 can be positioned at multiple axial locations along the egress tube 40, thereby providing an even greater ability to generate bubbles within a given area of bottom surface 14.

Still further, bath apparatus 10 includes a vibration assembly (not shown) in communication with bath chamber 12 for imparting vibration to bath chamber 12 to provide a massaging effect to the feet. The vibration assembly is turned on and off by actuation of the massage/heat switch 30. The vibration assembly includes a motor affixed to an underside of bath chamber 12, an output shaft rotatably driven by the motor, and a counterweight affixed to the output shaft. The vibration assembly is affixed underneath a central portion of bath chamber 12 by a motor support bracket. When the motor is electrically powered by actuation of massage/heat switch 30, rotation of the output shaft and the attached counterweight imparts vibrations to the motor support bracket, and these vibrations are then transferred to bath chamber 12 and the water contained therein in order to massage the feet. Foot baths with vibration assemblies are disclosed in further detail in the Kaufman et al. U.S. Pat. No. 6,568,000 and Ferber et al. U.S. Pat. No. 6,725,471, which have been incorporated by reference. The lower housing portion 38 includes a plurality of feet 48 constructed from a material such as rubber to resist movement of bath apparatus 10 along a supporting surface. It is fully contemplated that variable vibration intensities could be provided in accordance with the present invention.

The contact portion 20 is configured to receive massage attachments such as massage attachment 50, or such as the attachments disclosed in the Ferber et al. U.S. Pat. No. 6,725,471. Massage attachments advantageously allow for massage to be targeted to specific locations of the foot such as the ball, heel, or arch. As shown in FIG. 3, a motor 52 is disposed on an underside of the bath chamber 12, and may be attached to the underside of the contact portion 20 or to the lower housing portion 38 with a motor bracket 54, using screws (not shown). The various massage attachments are adapted to be received on an output shaft that is rotatably driven by the motor 52 and adapted to be accessible through the contact portion 20. The motorized rotation of the massage attachments such as the massage attachment 50, is activated by pressure of a body part applied thereon, which then establishes electrical contact to supply power to the motor 52. Alternatively, the motor 52 can be configured to operate when the user actuates a manual switch (not shown).

The contact portion 20 also includes a gel pad 56 mounted proximate to the massage attachment 50 for providing comfortable, padded, flexible support to a portion of the user's foot, such as the heel, as the user receives a massage effect from the massage attachment 50.

Referring now to FIG. 3, a fluid pump 58 is provided for pumping water through the showerheads 26, 28. The pump is controlled by the shower switch 32. It is shown that the fluid pump 58 includes an inlet 60 and an outlet 62. The inlet 60 is configured to draw fluid through an intake port 64 in the bath chamber bottom surface 14, which acts as a drain. The fluid pump 58 receives power through the electrical cord 36. Because the bath apparatus 10 may include devices and electrical circuits that require a voltage other than that provided by a standard electrical outlet, a transformer 66 is provided. In order to directly heat water in the bath chamber, the bath apparatus 10 may includes a heater 68. The heater 68 utilizes a resistive heating element 70, though the use of other types of heaters is contemplated. The heater 68 may be utilized in combination with, or as an alternative to the heating rope element.

Figure 4:
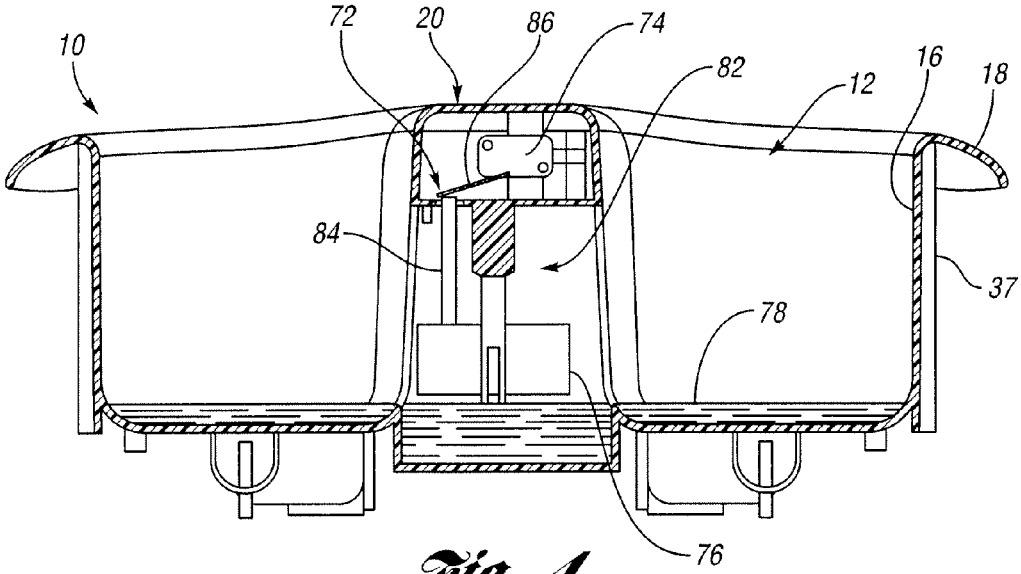
FIG. 4 is a partial sectional view of the bath apparatus of FIG. 1 shown including a float switch in a first position.
Figure 5:
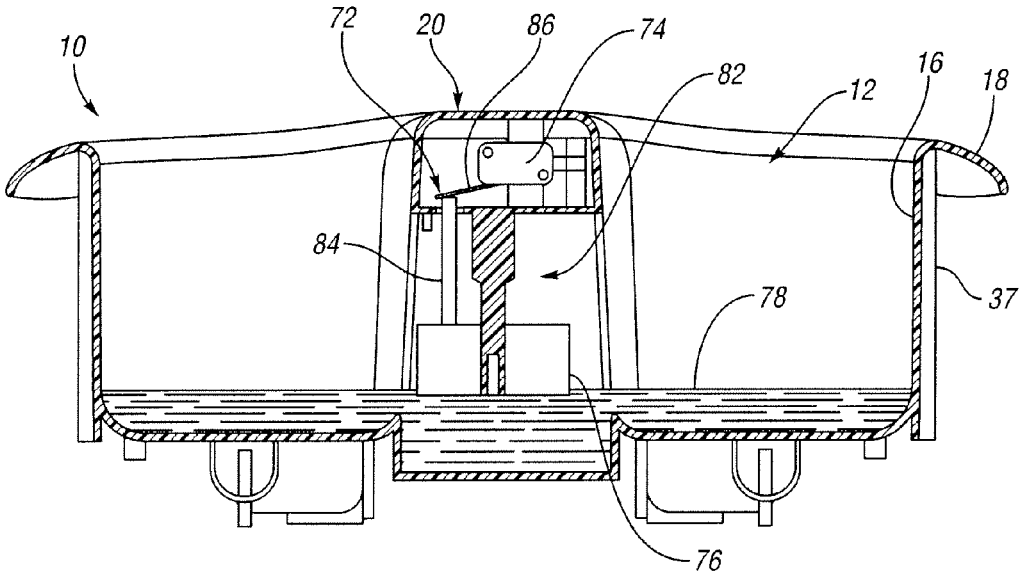
FIG. 5 is a partial sectional view of the bath apparatus of FIG. 1 shown with the float switch in a second position.

The bath apparatus 10 may also include a float switch 72, the operation of which is shown in FIGS. 4 and 5. The float switch 72 includes a switch portion 74 and a float portion 76. The switch portion 74 is in electrical communication with the fluid pump 58, the wiring for which is not illustrated, for clarity. As shown in FIGS. 4 and 5, the float portion 76 is configured to float in bath chamber fluid 78, thereby rising when the fluid level in the bath chamber 12 rises. As seen in FIGS. 1 and 3, the bath chamber 12 may include a plurality of slots 80, which allow the fluid to enter a float chamber 82—see FIGS. 4 and 5. In FIG. 4, the float portion 76 of the float switch 72 is at its lowest level. In fact, the level of the fluid 78 is not great enough to even contact the float portion 76. The switch portion 74 is shown in FIG. 4 in a first position, which prohibits operation of the fluid pump 58. In this way, the use of the float switch 72 helps to ensure that the fluid pump 58 will not operate unless an adequate amount of fluid 78 is in the bath chamber 12.

In FIG. 5, the fluid 78 is at a higher level, which has caused the float portion 76 of the float switch 72 to rise upward. When there is enough fluid 78 in the bath chamber 12, the float portion 76 rises to a certain level that is high enough to actuate the switch portion 74. In particular, an arm 84 is attached to the float portion 76 and contacts a switch lever 86 on the switch portion 74. This places the switch portion 74 in a second position which facilitates operation of the fluid pump 58. In addition to prohibiting operation of the fluid pump 58 when the fluid level in the bath chamber 12 is too low, the float switch 72 can be similarly configured to prohibit operation of the heater 68. Because the heater 68 is configured to heat the fluid in the bath chamber 12, having it connected to the float switch 72 helps to ensure that it will not unnecessarily operate when there is little or no fluid in the bath chamber 12. Of course, if desired, the float switch 72 can be configured to prohibit operation of all of the bath chamber 10 electrical devices, including the massage attachment motor 52 and the vibration motor.

Referring again to FIGS. 1 and 2, the lid 24 and the showerheads 26, 28 are described with greater detail. An outlet port 88 is provided at a forward region of the bath chamber 12. The outlet port 88 is in fluid communication with the outlet 62 of the fluid pump 58. A pair of fluid channels 90, 92 converge at a first end 94 for receiving fluid from the outlet port 88. The fluid channels 90, 92 each diverge to a second end 96, 98 at one of the showerheads 26, 28 respectively for conveying fluid from the outlet port 88 to the showerheads 26, 28.

Figure 6:
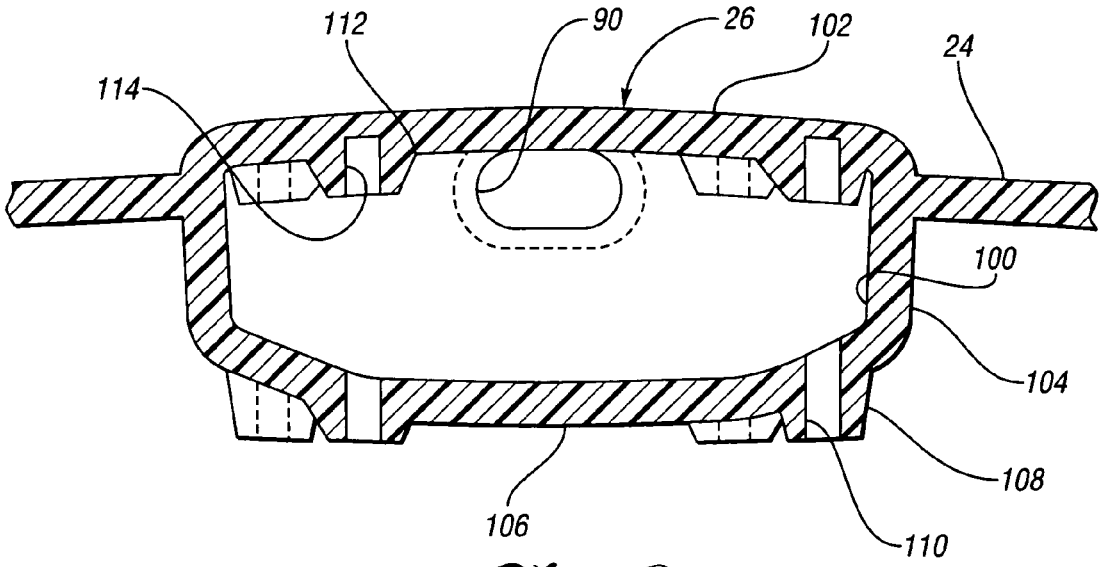
FIG. 6 is a partial section side view of a lid of the bath apparatus shown in FIG. 1, taken across a showerhead provided on the lid.

Referring now to FIG. 6, an exemplary showerhead 26 is illustrated by way of example in partial section view for greater detail. The showerhead 26 includes a cavity 100 bounded by a top portion 102 of the lid 24, a sidewall 104 that extends downward from the lid 24, and a nozzle plate 106 mounted to the sidewall 104. The nozzle plate 106 includes a series of nozzles 108 each having a nozzle aperture 110. Thus, the fluid is pumped through the channel 90 into the cavity 100, and consequently out of the cavity 100 through the nozzle apertures 110 thereby providing a pressurized water massage effect upon a top surface of the user's foot.

The showerheads 26, 28 and the channels 90, 92 are formed integrated with the lid 24. For example, the lid 24 may be injection molded as a single component, and the sidewalls 104, the nozzle plates 106 and the channels 90, 92 may be injection molded as a separate component. The showerheads 26, 28 and the channels 90, 92 may be assembled as water-tight duct-work upon affixing the sidewalls 104 and the channels 90, 92 to the underside of the lid 24. These components may be affixed together by friction welding or the like. By forming the showerheads 26, 28 and channels 90, 92 integral with the lid 24, a relatively lightweight and compact pressurized fluid apparatus is provided for the bath apparatus 10.

The lid 24, the showerheads 26, 28 and the channels 90, 92 are formed from a polymer that is at least partially transparent. This material characteristic permits a user to view activity beneath the lid 24. It also permits the user to view flow of fluid from the outlet port 88 through the channels 90, 92 and through the showerheads 26, 28. Thus, an aesthetically pleasing fluid flow visual effect is provided in combination with the pressurized fluid massage effect. Additionally, the partially transparent material characteristic permits a user to readily identify that showerheads 26, 28 are provided beneath the lid 24. Thus, a manufacturer does not have to rely on packaging alone to identify features of the bath apparatus 10. For example, prior art bath apparatuses that include water jets are readily viewable because they are typically provided on the bottom surface of the bath chamber, or on the sidewalls. Since the showerheads 26, 28 of the present invention are provided beneath the lid 24, the partially transparent feature permits consumers to identify otherwise concealed product traits by visual inspection and without further investigation.

In order to enhance such visual recognition, a series of false nozzle formations 112 are provided beneath the showerhead top portion 102, within the cavity 100. Due to the proximity of the false nozzle formations 112 to the top surface of the lid 24, a visual appearance is provided to the user that the showerheads 26, 28 include nozzles, such as the nozzles 108, even if the nozzles 108 are less noticeable than the nozzle formations 112. The false nozzle formations 112 each include a blind-depth hole 114 formed within the showerhead top portion 102 to enhance the recognition of the false nozzle formations 112 as actual nozzles, such as nozzles 108. Accordingly, the visual display of the showerheads 26, 28 is prominent by being viewed from atop the lid 24.

Although a simplified and integrated showerhead is illustrated by the showerhead 26 in FIG. 6, the invention contemplates that showerheads of varying complexities, such as having an adjustable nozzle array for providing various spray patterns or directions is contemplated within the spirit and scope of the present invention.

Figure 7:
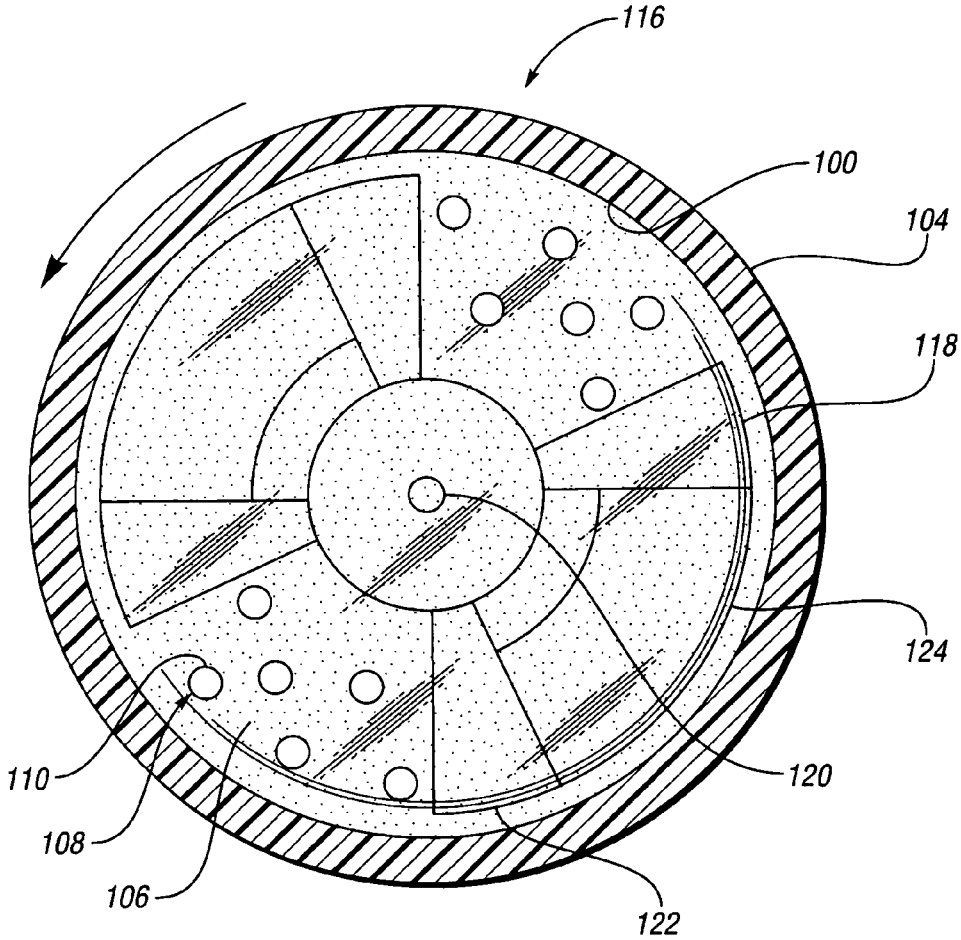
FIG. 7 is a partial sectional top view of an alternative embodiment showerhead in accordance with the present invention.

Referring now to FIG. 7, an alternative embodiment showerhead 116 is illustrated in accordance with the present invention. The showerhead 116 is similar to prior embodiment showerheads 26, 28 and includes a sidewall 104 enclosed by a nozzle plate 106, which includes a series of nozzles 108 with nozzle apertures 110 formed therethrough. The showerhead 116 includes an impeller 118 within a showerhead cavity 100. The impeller 118 is pivotally connected to at least one of the lid 24 or the nozzle plate 106. For example, blind-depth holes may be provided in the lid 24 and the nozzle plate 106; and the impeller 118 may include a pin 120 extending into the blind-depth holes so that the impeller 118 is fixed for rotation to the showerhead 116.

The impeller 118 includes a series of blades 122 such that the flow of fluid from the channel 90 through the nozzle apertures 110 causes the impeller 118 to rotate in the direction illustrated by an arcuate arrow in FIG. 7. The fan blades 122 interfere with the flow of fluid through the nozzles 108 thereby varying the output pressure for a given nozzle 108 as the impeller 118 rotates. Thus, a pulsating fluid massage effect is provided by the fan blades 122 interrupting the flow of fluid through the nozzles 108. Additionally, sequential fan blades 122 may be provided with a band 124 extending therebetween for limiting the flow of fluid through the nozzles 108 and for providing a dwell region across the pair of sequential fan blades 122. Various impeller designs may provide various pulsating pressurized fluid massage effects.

Referring again to FIGS. 1 to 3, the bath apparatus 10 further includes a handle 126. The handle 126 is generally arcuate and is pivotally connected to the bath chamber upper surface 18 at pivotal connections 128, 130 on lateral sides thereof. In the retracted orientation of the handle 126, as illustrated in FIGS. 1 to 3, the handle 126 is streamlined into an aesthetic appearance of the bath chamber upper surface 18. The pivotal connections 128, 130 are provided so that when the handle 126 is pivoted to an extended orientation, a central portion 132 of the handle 126 is disposed over a center a gravity for the bath apparatus 10 and fluid retained therein. Thus, the handle 126 assists in manual transportation and portability of the bath apparatus 10.

The lid 24 is further provided with a pair of spouts 134, 136 each disposed adjacent to the outlet port 88 on lateral sides thereof. The spouts 134, 136 provide openings in the lid 24 such that a user may dispose of fluid within the bath chamber 12 by grasping the handle 126 in the upright position and tilting the bath chamber 12 into an orientation wherein the spouts 134, 136 are lowered relative to the pivotal connections 128, 130. Thus, the user may dispose of the liquid by lifting a rear portion of the bath chamber 12 upward thereby pouring the liquid at a limited rate and region of flow for disposing the liquid. In summary, the bath apparatus 10 is provided with a pressurized massage effect from a showerhead, or a pair of showerheads 26, 28 for providing a pressurized massage effect upon an area of the user. In addition, the bath apparatus 10 is generally compact, lightweight and portable for facilitating filling, emptying, transportation and operation of the bath apparatus 10.

Figure 8:
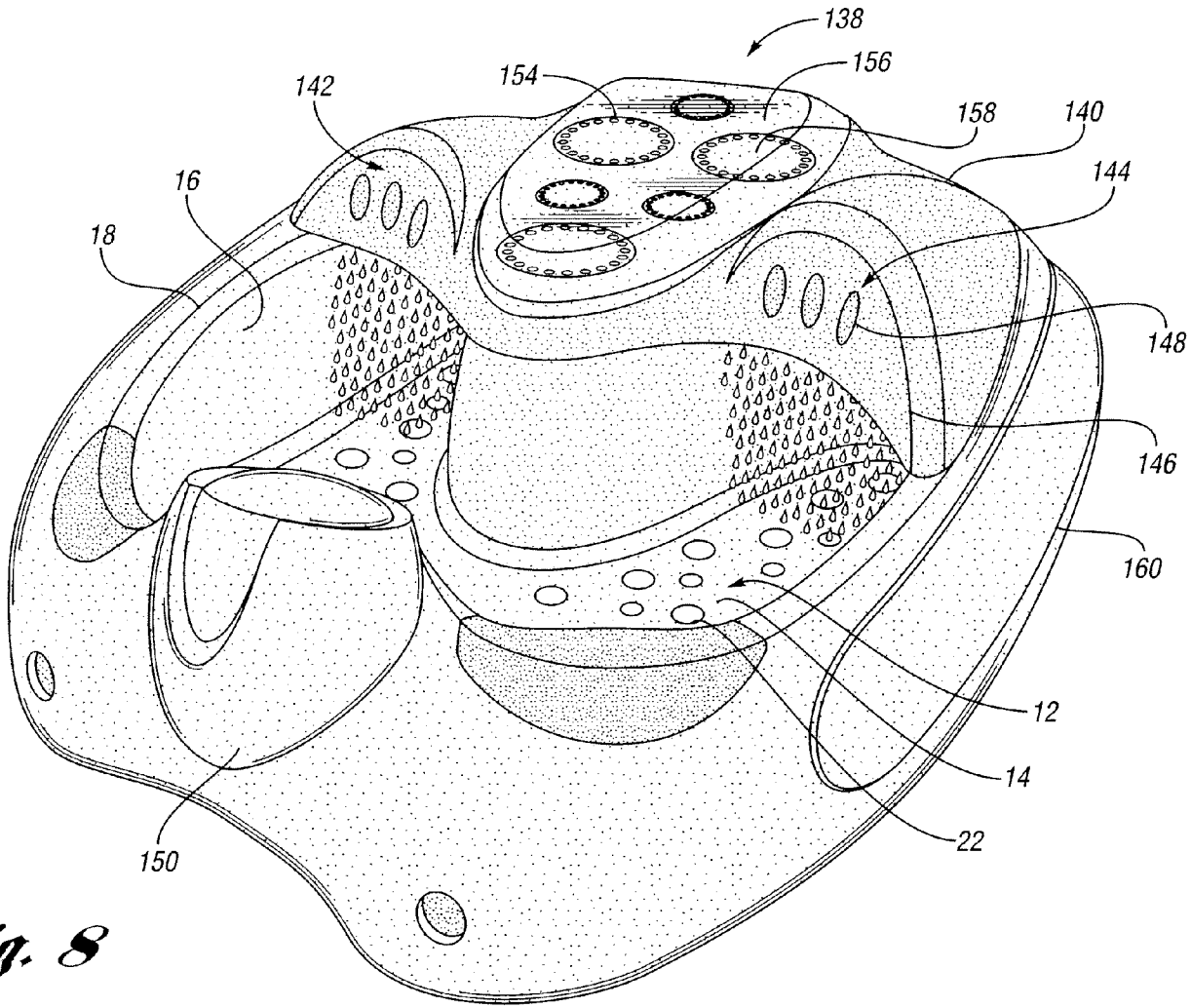
FIG. 8 is a perspective view of an alternative embodiment bath apparatus in accordance with the present invention.

Referring now to FIG. 8, an alternative embodiment bath apparatus 138 is illustrated in accordance with the present invention. The bath apparatus 138 includes a contoured lid 140 having showerheads 142, 144 formed on the underside thereof for providing a pressurized fluid massage effect upon a top surface of a user's feet. Since the contoured shape of the lid 140 provides an inclined surface 146 facing the user, this surface 146 may be provided with false nozzle formations 148 thereunder for viewing and appearance of a showerhead massage effect. The bath apparatus 138 may be provided with a pedicure station 150. The pedicure station 150 may retain a motorized pedicure apparatus for imparting a rotary pedicure effect to a body part of a user, particularly to the foot. Pedicure apparatuses are well known in the art, for providing treatment to the feet of a user. Pedicure apparatuses are often provided with multiple interchangeable attachments. Accordingly, a secondary lid 154 is pivotally connected to the lid 140 for enclosing a compartment 156 therebetween which retains a plurality of interchangeable pedicure attachments 158.

The bath apparatus 138 illustrates that the pressurized fluid massage effects provided by showerheads 142, 144, and the visual indication of such a feature may be provided in various bath apparatuses having various auxiliary features for providing an overall bathing, massage, pedicure and visual experience to the user.

The bath apparatus 138 also includes a handle 160 mounted to the bath chamber 12. Unlike the prior embodiment, the handle 160 is generally streamlined into the body of the bath apparatus 138 and is oriented below the top surface 18 of the bath chamber 12.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An apparatus for bathing a body part, the apparatus comprising:

a bath chamber for containing fluid, the bath chamber having an opening for receiving the body part therein;

a lid mounted to the bath chamber opening, the lid being sized to extend partially over the bath chamber;

a showerhead mounted to an underside of the lid, the showerhead being oriented towards the bath chamber; and a fluid pump in fluid communication with the bath chamber and the showerhead for drawing fluid from the bath chamber and pumping the fluid through the showerhead for providing a pressurized fluid massage effect upon the body part received within the bath chamber;

wherein the showerhead further comprises a cavity bounded by the lid, a sidewall extending from the lid and a nozzle plate mounted to the sidewall, the nozzle plate having a plurality of nozzles so that pressurized fluid is pumped into the cavity and through the plurality of nozzles.

2. The apparatus of claim 1 wherein the apparatus is portable for manual transportation.

3. The apparatus of claim 1 wherein the showerhead is integrated with the lid.

4. The apparatus of claim 1 wherein the showerhead further comprises a pair of laterally spaced apart showerheads for providing the pressurized fluid massage effect to a pair of body parts received within the bath chamber.

5. The apparatus of claim 1 wherein the lid is at least partially transparent so that a user may view the showerhead and the flow of fluid therethrough.

6. The apparatus of claim 1 further comprising a drain disposed within the bath chamber in fluid communication with the fluid pump for providing fluid to the fluid pump.

7. The apparatus of claim 1 wherein the showerhead is at least partially viewable from a top surface of the lid.

8. The apparatus of claim 1 further comprising:

a contact area adapted to be uncovered by fluid contained within the bath chamber; and a flexible contact pad mounted on the contact area for providing padded support to a body part.

9. The apparatus of claim 8 further comprising at least one massage attachment adapted to be received on the contact area for massaging the body part when the body part engages the massage attachment, the massage attachment being oriented adjacent to the contact pad so that the user may rest the body part upon the contact pad while engaging the massage attachment.

10. The apparatus of claim 1 further comprising a fluid channel in fluid communication with the pump and the showerhead for conveying fluid therebetween wherein the fluid channel is oriented on the underside of the lid.

11. The apparatus of claim 10 wherein the fluid channel is integrated with the lid.

12. The apparatus of claim 1 further comprising a float switch having a switch portion in electrical communication with the fluid pump, and a float portion configured to float in fluid contained in the bath chamber, thereby rising when the fluid level in the bath chamber rises, the switch portion having a first position for prohibiting operation of the fluid pump, and a second position for facilitating operation of the fluid pump, the float portion being further configured to cooperate with the switch portion to place the switch portion in the second position when the float portion rises to a certain level.

13. The apparatus of claim 12 further comprising a heater disposed in relation to the bath chamber for heating fluid contained in the bath chamber, the heater being in electrical communication with the float switch such that operation of the heater is prohibited when the switch portion is in the first position and operation of the heater is facilitated when the switch portion is in the second position.

14. The apparatus of claim 1 further comprising an impeller disposed within the cavity for rotation therein, the impeller being rotationally driven by the flow of fluid through the cavity, the impeller further comprising at least one blade that limits flow through at least one of the plurality of showerhead nozzles for providing a pulsating pressurized fluid massage effect upon the body part.

15. The apparatus of claim 1 wherein the lid and the showerhead are at least partially transparent so that a user may view the flow of fluid therethrough.

16. The apparatus of claim 15 wherein the showerhead further comprises a plurality of false nozzle formations provided within the cavity on the underside of the lid so that the user may visually identify the showerhead when the showerhead is not in operation.

17. The apparatus of claim 16 wherein each false nozzle configuration includes a blind-depth hole formed within the lid to provide a visual appearance of a nozzle aperture.

* * * * *